US010137046B1

(12) United States Patent
Pinus

(10) Patent No.: US 10,137,046 B1
(45) Date of Patent: Nov. 27, 2018

(54) DISPOSABLE BEDPAN WITH LID

(71) Applicant: Gustavo Guillermo Pinus, Buenos Aires (AR)

(72) Inventor: Gustavo Guillermo Pinus, Buenos Aires (AR)

( * ) Notice: Subject to any disclaimer, the term of this patent is extended or adjusted under 35 U.S.C. 154(b) by 6 days.

(21) Appl. No.: 15/484,241

(22) Filed: Apr. 11, 2017

Related U.S. Application Data

(63) Continuation-in-part of application No. 14/965,119, filed on Dec. 10, 2015.

(51) Int. Cl.
*A61G 9/00* (2006.01)

(52) U.S. Cl.
CPC ..... *A61G 9/003* (2013.01)

(58) Field of Classification Search
USPC ..... 4/451, 450
See application file for complete search history.

(56) References Cited

U.S. PATENT DOCUMENTS 3,460,164 A * 8/1969 Patton ..... A61G 9/003 4/451
5,689,840 A * 11/1997 Kuhlman ..... A61G 9/003 4/450
6,351,858 B1 3/2002 Toia
2006/0253968 A1* 11/2006 Mosler ..... A61G 9/003 4/450
2010/0263118 A1 10/2010 Tanguay
2010/0306913 A1 12/2010 Zazzara
2011/0185489 A1 8/2011 Partington
2012/0144575 A1 6/2012 Sanchez Moreno

FOREIGN PATENT DOCUMENTS

GB 2508663 A * 6/2014 ..... A61G 9/003

OTHER PUBLICATIONS

GB2508663.*

* cited by examiner

*Primary Examiner* — Lauren Crane
(74) *Attorney, Agent, or Firm* — Albert Bordas, P.A.

(57) ABSTRACT

A disposable bedpan with lid, having a bedpan with a base and a sidewall having at least one lateral support. The bedpan further has a top ridge and a front ridge. The bedpan further has a front top cavity defined between the top ridge and the front ridge. A cover has a cover base and a u-shaped cover base ridge. The u-shaped cover base ridge is inserted into the front top cavity when the cover mounts upon the bedpan. The cover is connected to the bedpan by a hinge. A lid has a lid panel and is connected to the bedpan by a lid hinge. The bedpan having the cover and lid are for a single use and are disposable. A plurality of the bedpan having the cover and the lid are stackable upon one another. The bedpan having the cover and the lid collects waste.

18 Claims, 6 Drawing Sheets

DISPOSABLE BEDPAN WITH LID

OTHER RELATED APPLICATIONS

The present application is a continuation-in-part of pending U.S. patent application Ser. No. 14/965,119, filed on Dec. 10, 2015, which is hereby incorporated by reference.

BACKGROUND OF THE INVENTION

1. Field of the Invention

The present invention relates to bedpans, and more particularly, to disposable bedpans with lids.

2. Description of the Related Art

Applicant believes that one of the closest references corresponds to U.S. Pat. No. 3,460,164 issued to Temple C. Patton on Dec. 13, 1966 for Disposable nestable bedpan. However, it differs from the present invention because Patton teaches a two-part disposable, nestable bedpan for collection of body wasted having an open-topped receptacle and a removable top section which has a seat which engages the upper edge of the open-topped receptacle. Both the open-topped receptacle and the seat are designed so that they are nestable with a plurality of other like receptacles and seats respectively; thereby effecting a substantial reduction in the spaced required storing the bedpans.

Applicant believes that another reference corresponds to U.S. Patent Application Publication No. 2010/0306913, published on Dec. 9, 2010 to Susan Zazzara for Leakproof disposable bedpan with integral biohazard containment. However, it differs from the present invention because Zazzara teaches a disposable biodegradable bedpan having antimicrobial agents that can be applied to the interior surfaces or infused into the bedpan during the molding process. The antimicrobial agents act to neutralize the biohazardous material within the human waste. The bedpan is designed with sloping walls such that it can be nested to facilitate storage. In addition, the bedpan can optionally contain an internal gelling agent to solidify liquid waste to avoid accidental spillage. Optional indicia are also provided on the inner wall of the bedpan to allow estimation of the volume of the contents. The bedpan has an optional lid that can be sealed after use to avoid spillage. The bedpan can be fabricated with molded paper pulp, or by an alternative biodegradable material such as PLA.

Applicant believes that another reference corresponds to U.S. Patent Application Publication No. 2011/0185489, published on Aug. 4, 2011 to Garry Partington et al. for Receptacle and support. However, it differs from the present invention because Partington et al. teach a disposable bedpan releasably mountable on a reusable or disposable annular support. The support has inner and outer walls and a plurality of support projections between the inner and outer walls which engage with the under surface of a peripheral lip of the disposable bedpan. The support supports the disposable bedpan in use and prevents collapsing and the soiled disposable bedpan can be disposed of to reduce the risk of cross-infection. When the support is disposable, e.g. made from paper pulp, this can also be disposed of in the macerator.

Applicant believes that another reference corresponds to U.S. Patent Application Publication No. 2012/0144575, published on Jun. 14, 2012 to Jaime Alberto Sanchez Moreno for Methods and systems for collecting and disposing of human waste. However, it differs from the present invention because Moreno teaches systems and methods for collecting biological waste from a human person. The systems have a bedpan with a receptacle base and a floor; a side wall also have a lid engagable to cover the substantially open top, the lid being provided with an aperture therethrough. The systems have a disposable bag having dimensions so as to allow the disposable bag to cover the bedpan, and to line the interior. The disposable bag dispenser is configured to store and dispense a disposable bag prior to use by the human person. The systems have an elongate, substantially planar spatula.

Applicant believes that another reference corresponds to U.S. Patent Application Publication No. 2010/0263118, published on Oct. 21, 2010 to Eric Tanguay for Bedpan having a handle defined therein. However, it differs from the present invention because Tanguay teaches a bedpan having a body member defining a reservoir, the reservoir being shaped and dimensioned for receiving bodily waste, the body member including a receptacle portion shaped for receiving therein a bedpan liner and an open support section including a central opening providing access to the reservoir defined by the body member. The support section is defined by a peripheral wall extending downwardly from a peripheral edge of the central opening into the reservoir. A bottom wall may or may not be provided at a bottom of the peripheral wall. If it is provided, it is defined at a downward edge of the peripheral wall opposite to the central opening to close a bottom of the reservoir. At least one handle is provided for insertion and removal of the bedpan under a patient's buttocks, the handle including an opening extending through at least one of the bottom wall and the peripheral wall. The central opening of the reservoir is covered by the bedpan liner when the liner is received by the receptacle portion.

Applicant believes that another reference corresponds to U.S. Pat. No. 6,351,858 issued to Mario Fernando Toia on Mar. 5, 2002 for a Disposable Container for Collecting Human Wastes and a Container-Grinding Machine. However, it differs from the present invention because Toia teaches a process for disposing of human waste in an efficient and environmentally or pathologically safe manner, a grindable container for collecting human waste and a crushing machine for said containers. The container is made of a grindable, biodegradable material such as cellulose pulp and is designed to hold human waste without any leaks or cracks. The container is formed by an upper portion and a lower portion, both comprising corresponding snap-in peripheral engaging flanges for engaging one to the other without the use of gluing products and comprising an anti-slipping surface finish for avoiding slippage of the container during usage and designed for comfortable human skin contact. The crushing machine is designed to be used at any health-care or rest-home center and is adequate for dumping the final product into a sewer system in an environmental caring manner.

Other patents describing the closest subject matter provide for a number of more or less complicated features that fail to solve the problem in an efficient and economical way. None of these patents suggest the novel features of the present invention.

SUMMARY OF THE INVENTION

The present invention is a disposable bedpan with lid, comprising a bedpan having a base and a sidewall having at least one lateral support. The bedpan further comprises a top ridge and a front ridge. The bedpan further comprises a front top cavity defined between the top ridge and the front ridge. A cover comprises a cover base and a u-shaped cover base ridge. The u-shaped cover base ridge is inserted into the front top cavity when the cover mounts upon the bedpan. The cover is connected to the bedpan by a hinge. A lid comprises a lid panel and is connected to the bedpan by a lid hinge.

The bedpan having the cover and lid is for a single use and is disposable. A plurality of the bedpan having the cover and the lid are stackable upon one another. The bedpan having the cover and the lid collects waste.

The lid panel comprises at least one lid ridge that extends perpendicularly across the lid panel. The lid further comprises a panel extension. The lid comprises a panel fold between the lid panel and the panel extension. The panel extension comprises at least one panel ridge that extends perpendicularly across the panel extension. The lid further comprises at least one panel locking protrusion that secures upon the cover when in a closed configuration.

The base comprises at least one ridge. The at least one ridge extends perpendicularly across the base. The at least one lateral support protrudes inwardly from the sidewall. Each of the at least one lateral support is tapered from the base towards the top ridge.

The bedpan further comprises a front base support. The bedpan further comprises a front bottom cavity defined between the base and the front base support. The bedpan further comprises a base support.

The cover further comprises a cover front ridge. The cover further comprises a cover front top cavity defined between the cover front ridge and the cover base.

It is therefore one of the main objects of the present invention to provide a disposable bedpan with lid comprising a bedpan having an attached cover and an attached lid.

It is another object of this invention to provide a disposable bedpan with lid, whereby the bedpans, each having an attached cover and an attached lid, are stackable.

It is another object of this invention to provide a disposable bedpan with lid that sustains the weight of a user thereon.

It is another object of this invention to provide a disposable bedpan with lid that is volumetrically efficient for carrying, transporting, and storage.

It is another object of this invention to provide a disposable bedpan with lid that can be readily configured for use and closed without the need of any special tools.

It is yet another object of this invention to provide such a bedpan that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
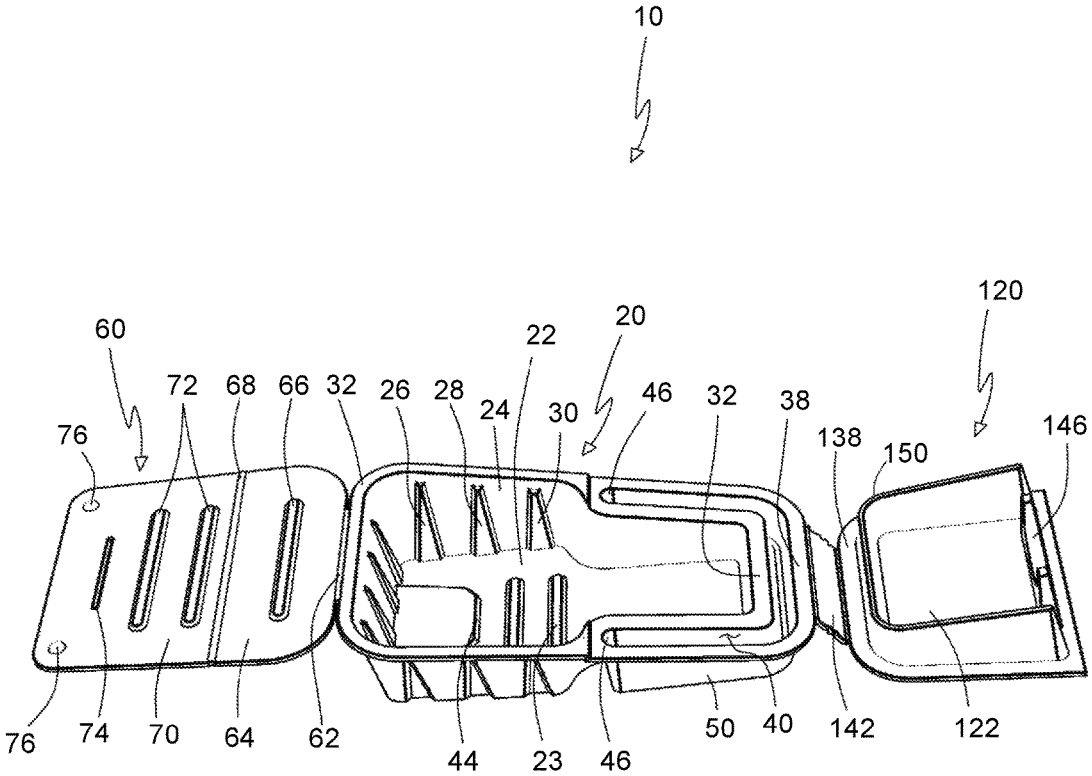
FIG. 1 represents a top isometric view of a disposable bedpan with lid.

Referring now to the drawings, the present invention is a disposable bedpan with lid and is generally referred to with numeral 10. It can be observed that it basically includes bedpan 20, lid 60, and cover 120.

Figure 2:
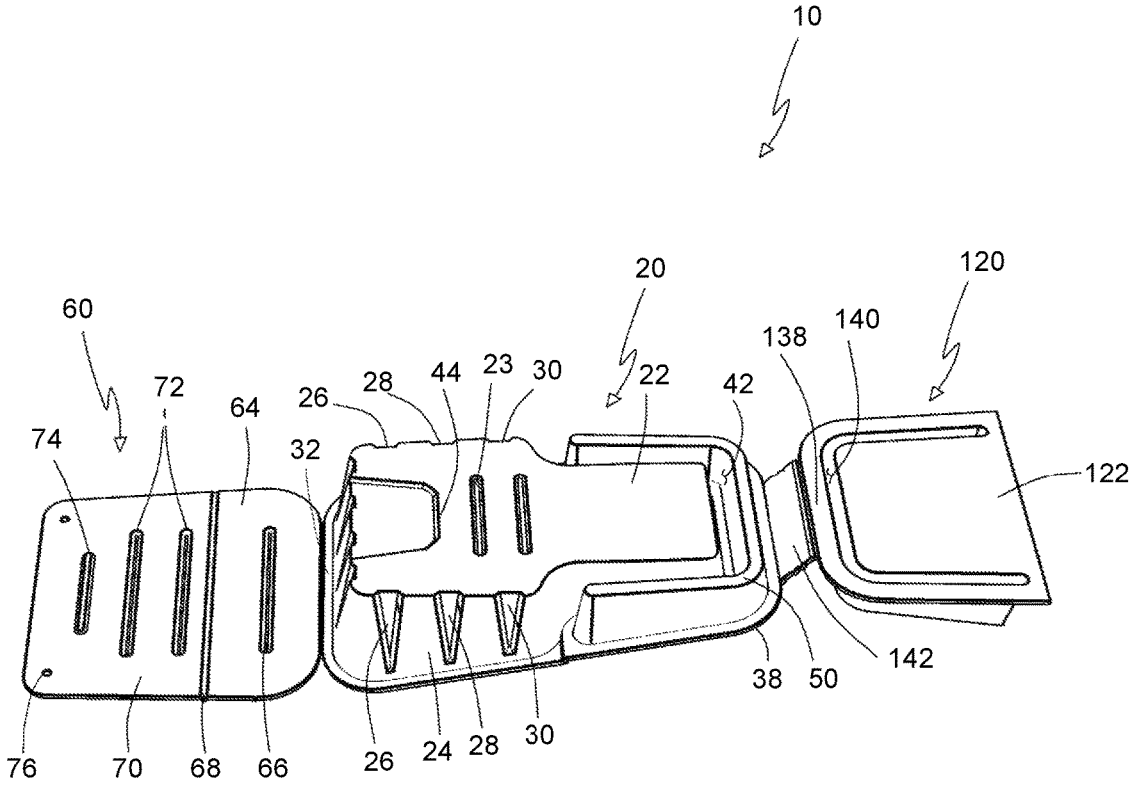
FIG. 2 represents a bottom isometric view of the disposable bedpan with lid.

As seen in FIGS. 1 and 2, disposable bedpan with lid 10 comprises bedpan 20 having base 22 and sidewall 24 with at least one lateral support. In a preferred embodiment, bedpan 20 is symmetrical, whereby sidewall 24 has a set of each lateral supports 26, 28, and 30 on its longitudinal sides. Bedpan 20 further comprises top ridge 32 and front ridge 38. Each lateral supports 26, 28, and 30 protrude inwardly from sidewall 24, and are tapered from base 22 towards top ridge 32. Base 22 comprises at least one ridge 23. Each ridge 23 extends perpendicularly across base 22. In a preferred embodiment, ridges 23 protrude inwardly from base 22. Front top cavity 40 is defined between top ridge 32 and front ridge 38, and extends to ends 46. Front ridge 38 contours and extends along a perimeter section of top ridge 32. Bedpan 20 further comprises front base support 50. Front bottom cavity 42 is defined between base 22 and front base support 50. Bedpan 20 further comprises base support 44.

Disposable bedpan with lid 10 also comprises lid 60. Lid 60 comprises lid panel 64. Lid 60 is connected to bedpan 20 by lid hinge 62. Lid panel 64 comprises at least one lid ridge 66 that extends perpendicularly across lid panel 64. Lid 60 further comprises panel extension 70. Between lid panel 64 and panel extension 70 is panel fold 68. Panel extension 70 comprises at least one panel ridge 72 and/or 74 that extends perpendicularly across panel extension 70. Lid 60 further comprises at least one panel locking protrusion 76 that secures upon cover 120 when in a closed configuration. More specifically and in a preferred embodiment, ends 46 are shaped to snugly receive respective locking protrusions 76.

Disposable bedpan with lid 10 also comprises cover 120 having cover base 122. Cover 120 is connected to bedpan 20 by hinge 142. Cover 120 further comprises cover front ridge 138. Cover 120 further comprises cover front top cavity 140 defined between cover front ridge 138 and cover base 122. Cover base support 146 forms an arch. Cover 120 further comprises cover base ridge 150 that is u-shaped. In a preferred embodiment, cover 120 is symmetrical.

It is noted that for carrying, transporting, and/or storage, present invention 10 is in an open configuration, whereby neither lid 60, nor cover 120 are mounted onto bedpan 20.

Figure 3:
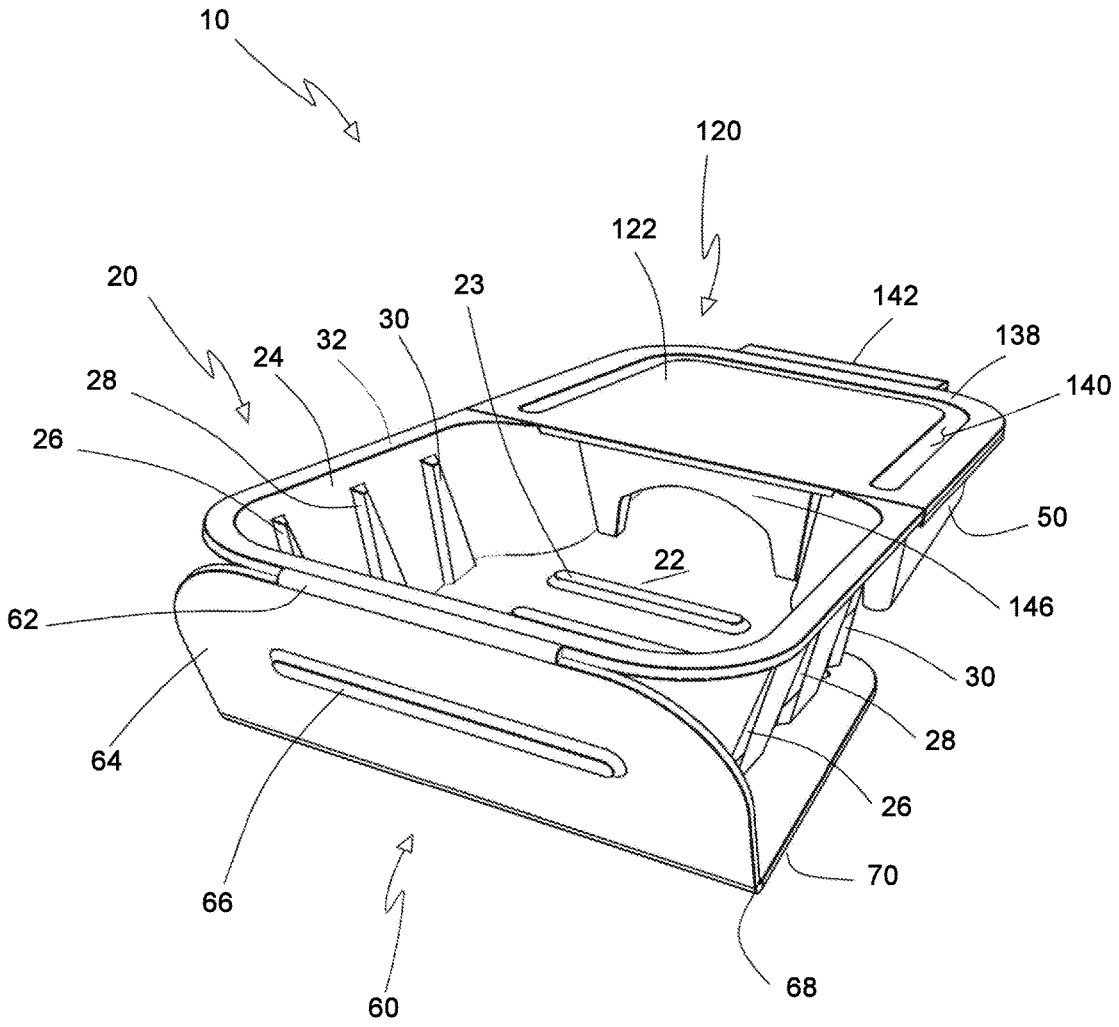
FIG. 3 represents a first isometric view of the disposable bedpan with lid configured for use.
Figure 4:
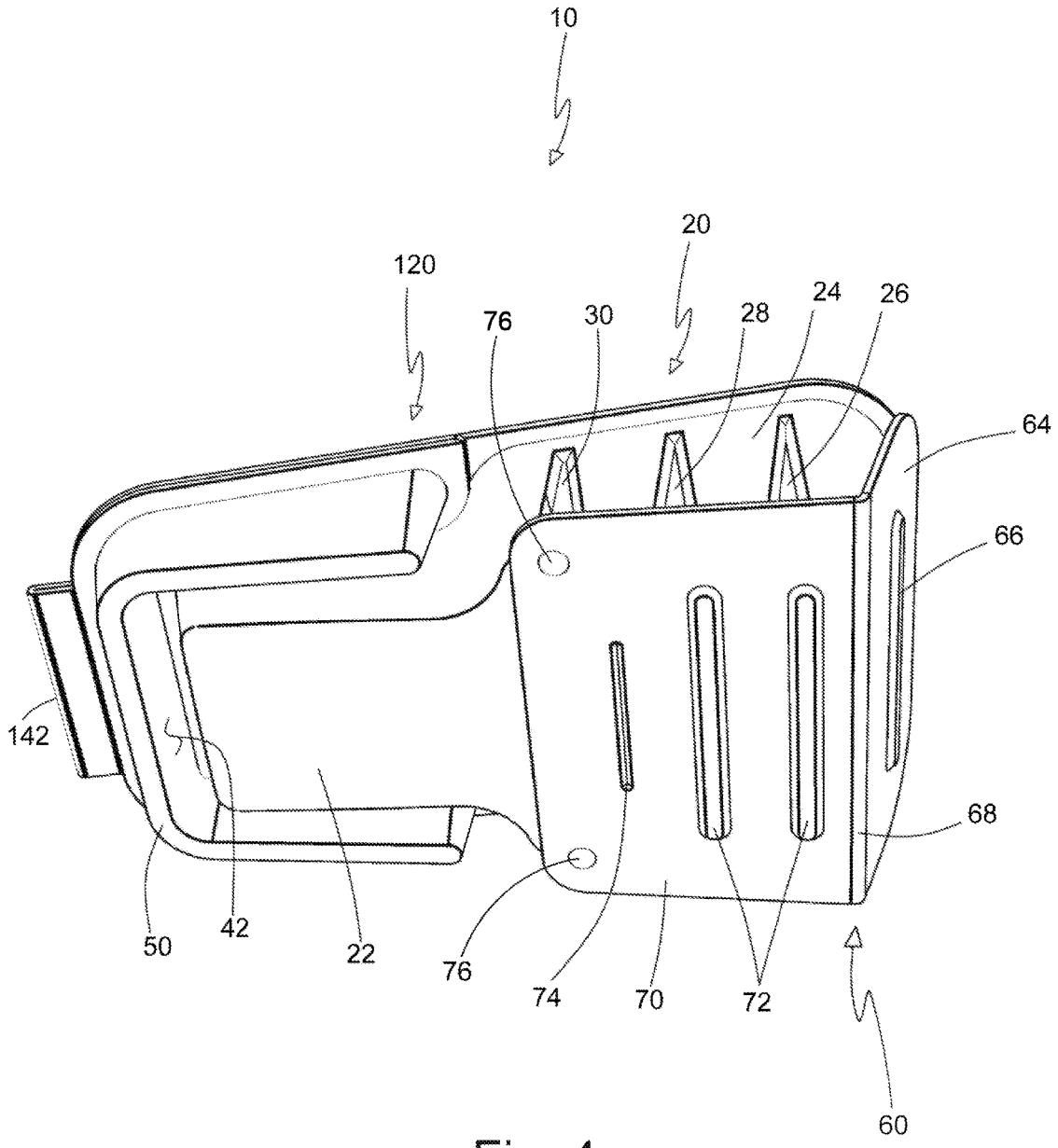
FIG. 4 represents a second isometric view of the disposable bedpan with lid configured for use.

As seen in FIGS. 3 and 4, present invention 10 is configured for use, whereby cover 120 mounts upon bedpan 20 to support a user thereon. More specifically, cover 120 folds at hinge 142 as cover base ridge 150 is received by front top cavity 40, seen in FIGS. 1 and 2, until cover base support 146 rests upon base 22. In addition, lid 60 folds at lid hinge 62, and at panel fold 68 so that panel extension 70 is positioned beneath base 22. Bedpan 20 collects waste including urine and feces or excrement. The waste can be from a human, or a pet such as a dog or cat. Disposable bedpan with lid 10 is disposable, intended for a single use and is constructed of biodegradable materials.

Figure 5:
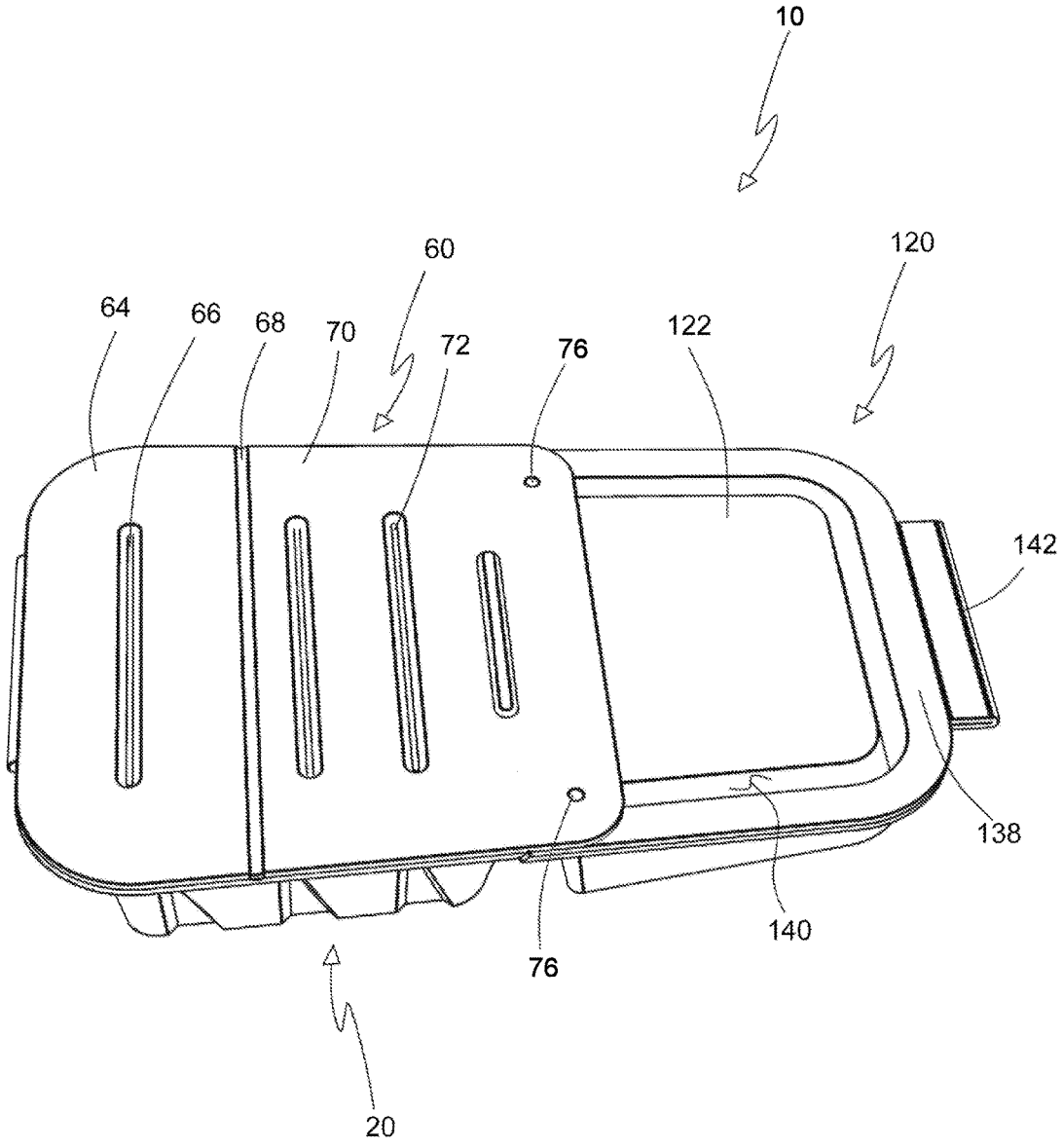
FIG. 5 represents an isometric view of the disposable bedpan with lid in a closed configuration after use.

As seen in FIG. 5, present invention 10 is in a closed configuration after use, whereby ends 46 are shaped to snugly receive respective locking protrusions 76, seen in FIG. 1. Thus allowing panel locking protrusions 76 of lid 60 to snap into ends 46 of cover 120. In the closed configuration, present invention 10 contains the waste for safe disposal.

Figure 6:
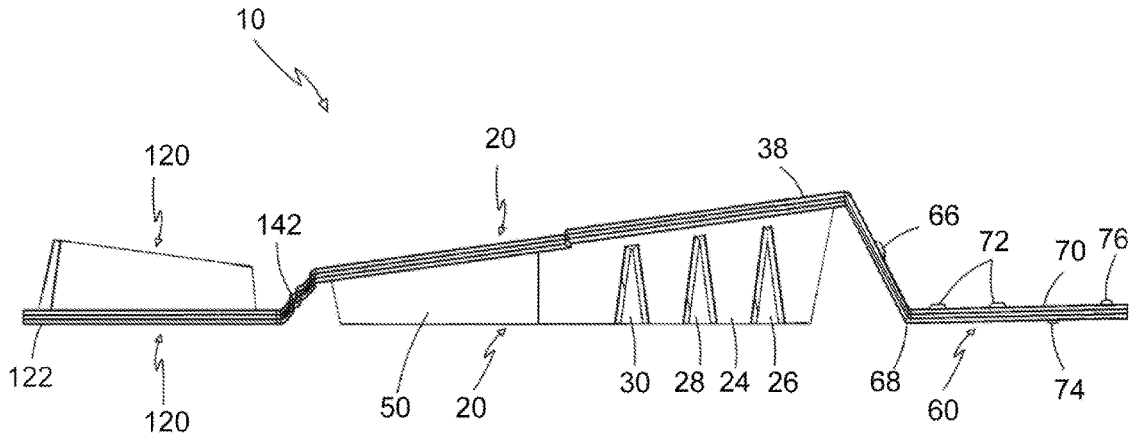
FIG. 6 is a side view of three stacked disposable bedpans with lids that are volumetrically efficient for carrying, transporting, and/or storage.

As seen in FIG. 6, a plurality of present inventions 10 are stackable upon one another to be volumetrically efficient for carrying, transporting, and/or storage, whereby a front top cavity 40 from a first bedpan 20 receives a front base support 50 from a second bedpan 20, while a cover front top cavity 140 from the second cover 120 receives a cover base ridge 150 from the first cover 120, and lids 60 stack one upon another.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A disposable bedpan with lid, comprising:

A) a bedpan comprising a base and a sidewall having at least one lateral support, said bedpan further comprises a top ridge and a front ridge, said bedpan further comprises a front top cavity defined between said top ridge and said front ridge;

B) a cover comprising a cover base and a u-shaped cover base ridge, said u-shaped cover base ridge is inserted into said front top cavity when said cover mounts upon said bedpan, said cover is connected to said bedpan by a hinge; and C) a lid comprising a lid panel, said lid is connected to said bedpan by a lid hinge, said lid further comprises at least one panel locking protrusion that secures upon said cover when in a closed configuration, said cover and said lid seal said bedpan to prevent waste from coming out when in said closed configuration, said lid panel comprising at least one lid ridge.

2. The disposable bedpan with lid set forth in claim 1, further characterized in that said bedpan having said cover and said lid are for a single use.

3. The disposable bedpan with lid set forth in claim 1, further characterized in that said bedpan having said cover and said lid are disposable.

4. The disposable bedpan with lid set forth in claim 1, further characterized in that a plurality of said bedpan having said cover and said lid are stackable upon one another.

5. The disposable bedpan with lid set forth in claim 1, further characterized in that said bedpan having said cover and said lid collects said waste.

6. The disposable bedpan with lid set forth in claim 1, further characterized in that said at least one lid ridge extends perpendicularly across said lid panel.

7. The disposable bedpan with lid set forth in claim 1, further characterized in that said lid further comprises a panel extension.

8. The disposable bedpan with lid set forth in claim 1, further characterized in that said lid comprises a panel fold between said lid panel and said panel extension.

9. The disposable bedpan with lid set forth in claim 1, further characterized in that said panel extension comprises at least one panel ridge that extends perpendicularly across said panel extension.

10. The disposable bedpan with lid set forth in claim 1, further characterized in that said base comprises at least one ridge.

11. The disposable bedpan with lid set forth in claim 10, further characterized in that said at least one ridge extends perpendicularly across said base.

12. The disposable bedpan with lid set forth in claim 1, further characterized in that said at least one lateral support protrudes inwardly from said sidewall.

13. The disposable bedpan with lid set forth in claim 1, further characterized in that each of said at least one lateral support is tapered from said base towards said top ridge.

14. The disposable bedpan with lid set forth in claim 1, further characterized in that said bedpan further comprises a front base support.

15. The disposable bedpan with lid set forth in claim 14, further characterized in that said bedpan further comprises a front bottom cavity defined between said base and said front base support.

16. The disposable bedpan with lid set forth in claim 1, further characterized in that said bedpan further comprises a base support.

17. The disposable bedpan with lid set forth in claim 1, further characterized in that said cover further comprises a cover front ridge.

18. The disposable bedpan with lid set forth in claim 17, further characterized in that said cover further comprises a cover front top cavity defined between said cover front ridge and said cover base.

* * * * *